US010422085B2

(12) United States Patent
Coats

(10) Patent No.: US 10,422,085 B2
(45) Date of Patent: Sep. 24, 2019

(54) TIE PLATE FOR RAILROAD TRACKS WITH SPIKE PROTECTORS

(71) Applicant: PANDROL LIMITED, Surrey (GB)

(72) Inventor: Frank Howard Coats, Thorofare, NJ (US)

(73) Assignee: Pandrol Limited, Surrey (GB)

( * ) Notice: Subject to any disclaimer, the term of this patent is extended or adjusted under 35 U.S.C. 154(b) by 90 days.

(21) Appl. No.: 15/685,755

(22) Filed: Aug. 24, 2017

(65) Prior Publication Data

US 2018/0058012 A1 Mar. 1, 2018

Related U.S. Application Data

(60) Provisional application No. 62/379,848, filed on Aug. 26, 2016.

(51) Int. Cl.

| | |
|---|---|
| ***E01B 9/14*** | (2006.01) |
| ***E01B 9/48*** | (2006.01) |
| ***E01B 9/12*** | (2006.01) |
| ***E01B 9/44*** | (2006.01) |

(52) U.S. Cl.

CPC ..... *E01B 9/14* (2013.01); *E01B 9/12* (2013.01); *E01B 9/44* (2013.01); *E01B 9/48* (2013.01); *E01B 2201/02* (2013.01)

(58) Field of Classification Search

CPC ..... E01B 9/12; E01B 9/14
USPC ..... 238/370, 371
See application file for complete search history.

(56) References Cited

U.S. PATENT DOCUMENTS

| | | | | | |
|---|---|---|---|---|---|
| 1,156,811 | A | * | 10/1915 | Prince et al. | F16B 13/0891 411/357 |
| 1,241,857 | A | * | 10/1917 | Kendrick | E01B 9/16 238/371 |
| 1,263,665 | A | | 4/1918 | Harsh | |
| 1,294,778 | A | * | 2/1919 | Cutting | E01B 9/16 238/371 |
| 1,774,968 | A | * | 9/1930 | Gorrell | E01B 9/14 238/371 |
| 1,855,329 | A | * | 4/1932 | Wagner | E01B 9/16 238/366 |
| 3,191,864 | A | * | 6/1965 | Moses | E01B 9/16 156/91 |
| 3,196,583 | A | * | 7/1965 | Rex | E01B 9/28 238/371 |
| 3,964,680 | A | * | 6/1976 | Arthur | E01B 9/16 238/366 |
| 4,134,546 | A | * | 1/1979 | Dankert | E01B 9/16 238/370 |
| 4,203,193 | A | * | 5/1980 | Arthur | E01B 9/06 238/366 |

(Continued)

FOREIGN PATENT DOCUMENTS

| | | |
|---|---|---|
| DE | 3923565 | 12/1990 |
| EP | 0167106 | 1/1986 |

*Primary Examiner* — Jason C Smith

(74) *Attorney, Agent, or Firm* — Gottlieb, Rackman & Reisman, PC

(57) ABSTRACT

Typically, a tie plate assembly for supporting a rail on a tie includes a tie plate and a spike that is driven through the plate into the tie to secure the tie plate to the point. A sleeve is provided on the plate that is inserted into a tie to prevent the deflection of the spike with respect to the ties wheels of a train pass over the tie.

16 Claims, 8 Drawing Sheets

(56) References Cited

U.S. PATENT DOCUMENTS

| | | | | |
|---|---|---|---|---|
| 4,802,623 | A * | 2/1989 | Fasterding | E01B 3/32 238/44 |
| 5,332,153 | A * | 7/1994 | Leibhard | E01B 9/14 238/373 |
| 5,593,089 | A * | 1/1997 | Coomer | E01B 9/06 238/370 |
| 5,758,821 | A * | 6/1998 | Wirthwein | E01B 9/06 238/366 |
| 6,655,296 | B2 | 12/2003 | Theurer | |
| 9,684,511 | B2 | 6/2017 | Shanbhogue et al. | |
| 2010/0224691 | A1* | 9/2010 | McQuistian | E01B 9/06 238/371 |
| 2013/0168461 | A1* | 7/2013 | Schnyder | E01B 9/16 238/370 |
| 2017/0183828 | A1* | 6/2017 | Jia | E01B 9/18 |
| 2018/0058012 | A1* | 3/2018 | Coats | E01B 9/14 |

* cited by examiner

TIE PLATE FOR RAILROAD TRACKS WITH SPIKE PROTECTORS

CROSS-REFERENCE TO RELATED APPLICATION

This patent application claims priority under 35 U.S.C. § 119 to U.S. Provisional Patent Application No. 62/379,848, filed Aug. 26, 2016, which is hereby incorporated by reference herein in its entirety as part of the present disclosure.

FIELD OF THE INVENTION

This patent application pertains generally to railroad rails support systems and more specifically to a plate that supports railroad rails on ties with spikes where the plate is formed with integral sleeves that extend downwardly, receive the spikes and protect the spikes from bending and breaking.

BACKGROUND OF THE INVENTION

Steel tie plates and "cut" spikes or other types of spikes have been commonly used to fasten railway rails to wooden crossties since the late 1800s. A vital function of the spikes is to transfer lateral forces from the train wheels to the crossties (or ties) as a train runs over the rails. Over time, a deformation zone can be created in a wooden tie, forming cavities from the top surface of the tie partially along two opposite sides of the spike. Once these cavities are formed, as each wheel runs over a rail, in response to the lateral forces, the spike is free to flex back and forth, much like a flagpole in wind. This flexing causes cracks in the spike, typically about one to two inches beneath the top surface of the wooden tie. Eventually, as a result of fatigue, the spike breaks at the flexing point.

Broken spikes are difficult to detect visually even by professional railway track rail inspectors and have resulted in numerous train derailments all over the world, causing death and injuries, as well as extensive property damage and delays in train movements. As rail shipments of cargo increase, these derailments become increasingly unacceptable, especially if the cargo includes hazardous materials.

Additionally, water and foreign materials, such as dirt and sand, can get into the deformation zones causing damage to the ties, the plate and the spike, reducing the useful life of plates, ties and spikes and requiring more frequent replacements of these components. Thus, the overall maintenance costs of the respective rails is increased by the breakage of the spikes.

There have been many attempts to solve the problem of transferring lateral loads into wooden crossties. For example, plates have been made with ridges or other projections on their bottom surface. However, these approaches were not very successful because they resulted in crushed and damaged wood fibers, thereby reducing the useful life of the tie. In addition, the plates settled into the tie over time, requiring the spikes to be re-driven.

SUMMARY OF THE INVENTION

The present invention relates to a railway tie plate that includes rigid hollow cylinders or sleeves that house spikes and prevent the spikes from breaking and prevent the generation of deformation zones in wooden crossties. The present invention does not crush and damage the wood fibers of the ties and does not require frequent re-tightening of spikes, providing an improved long term solution to the problem described above.

The sleeves can be of any shape (e.g., round or square) and can be rigidly affixed to the tie plate by welding, press fitting, or other means. Alternatively, the sleeves can be made integral with the plate. The sleeve and the hole can be concentric. As the spike is driven into tie plate, the spike passes through the hollow sleeve and into the wooden crosstie, securing the tie plate to the tie. The sleeve transfers the bending moment of the spike into the tie plate. The inclusion of the sleeve also increases the bearing area for the transfer of lateral loads, a more uniform bearing stress over the bearing area, and decreased opportunity for water to infiltrate the bearing stress zone in the wood. As such, the plate also preserves wood fiber strength and lessens water-related degradation such as rust, decay, wood degradation and iron degradation.

The sleeve can include a bushing (e.g., plastic bushings) or a coating to further protect the wood fibers of the ties from wear and further increase the weight bearing area surrounding the spike.

In an embodiment, the present invention is directed to a plate assembly for supporting and attaching a rail on a tie using a spike that comprises a tie plate that has a hole for receiving and securing the spike, a clip that is arranged to secure the rail to the tie plate and a sleeve that is attached to the plate and extends downwardly from the plate when the plate is mounted on the tie. The sleeve is dimensioned to prevent lateral flexing of the spike after the spike has been inserted through the hole and the sleeve.

In an embodiment, the present invention is directed to a tie plate supporting a rail on a wood tie by a spike. The tie plate comprises a tie plate body that has a generally flat shape with a plate bottom surface and a sleeve that defines an orifice receiving the spike. The sleeve is sized and shaped to prevent deflection of the spike when the spike is inserted through the orifice and is imbedded in the wood tie.

The tie plate body can be formed with a hole and the sleeve can be sized and shaped to pass through the hole. The sleeve and tie can have matching cross-sectional shapes.

In an embodiment, the present invention is directed to a method of attaching a tie plate to a tie. The tie plate includes a generally flat bottom surface and a sleeve that extends from the bottom surface and defines an orifice. The method comprises the steps of attaching the tie plate to the tie with the sleeve extending into the tie and driving a spike through the hole until a portion of the spike is imbedded in the tie and securing the tie plate to the tie, with the sleeve being positioned to prevent lateral deflection of the spike. The sleeve can extend into tie by about 1 to 2 inches.

The tie can be predrilled form a hole in the tie receiving the sleeve. The bottom surface of the plate can have a plurality of sleeves arranged in a pattern and the tie can be predrilled to form a plurality of holes for receiving the sleeves, the holes being generated simultaneously. The plurality of sleeves can be arranged in a pattern, and the tie can be predrilled using a jig with a plurality of drill heads arranged in the pattern to predrill the tie with holes.

In an embodiment, the crosstie can be prepared for inclusion of the tie plate by using a plurality (e.g., four) rigid cylindrical drills ganged together to drill all required holes in a tie simultaneously. The tie plate can then pressed down on top of the tie with the sleeves being inserted through the holes formed in the tie. The plate can then be attached to the tie using straight and/or threaded spikes.

For threaded spikes a two-stage drill bit can be used that bores a staged hole starting from the top section that has a larger diameter for the sleeve and a lower section with a smaller diameter for the spike.

DETAILED DESCRIPTION OF EMBODIMENTS OF THE INVENTION

Figure 1:
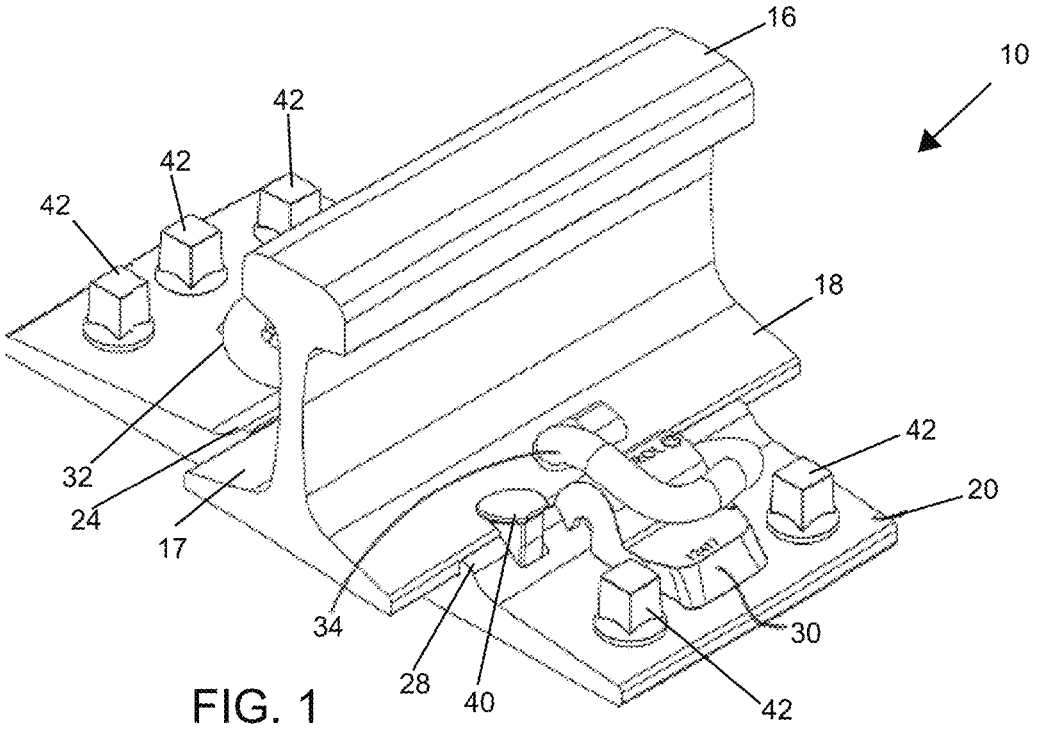
FIG. 1 is a perspective view of a known conventional plate assembly supporting a rail on a tie.
Figure 2:
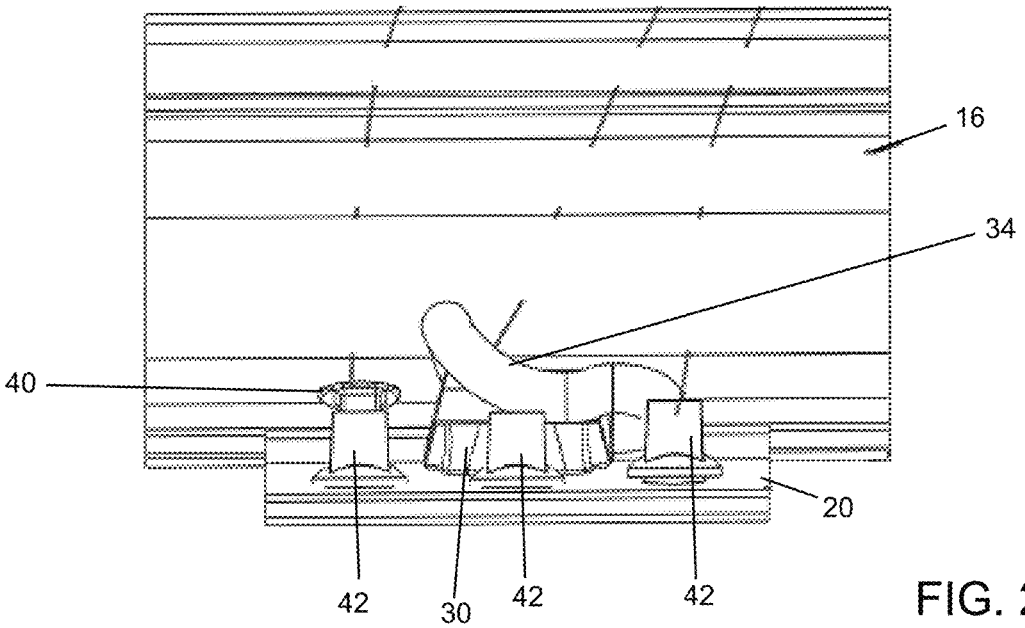
FIG. 2 is a side view of the plate assembly of FIG. 1.
Figure 3:
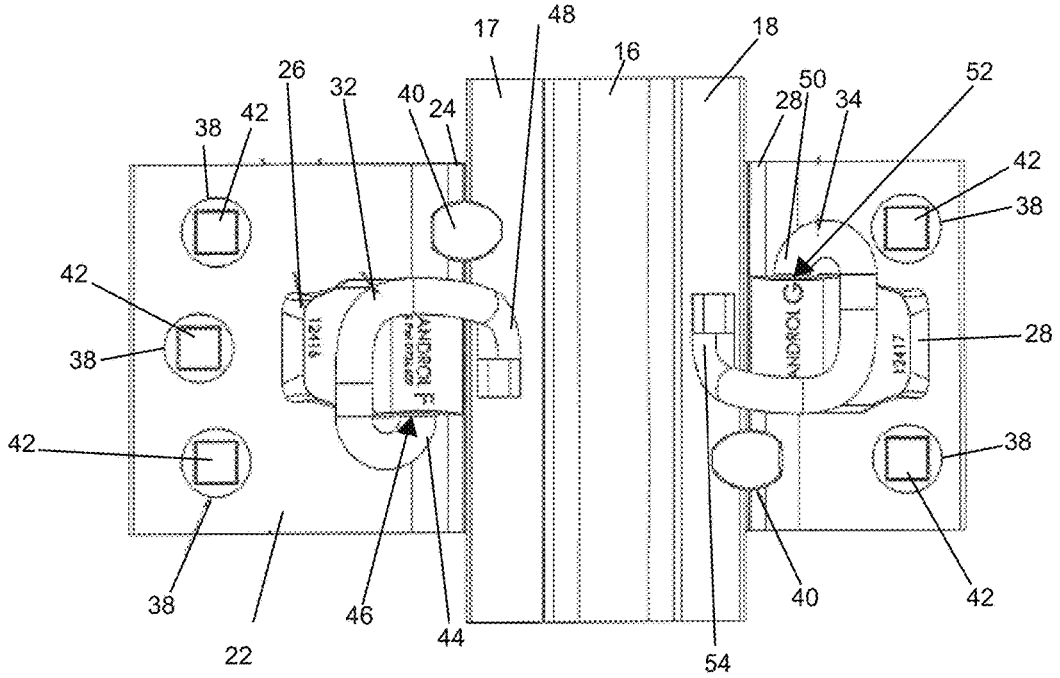
FIG. 3 is a plan view of the plate assembly of FIG. 1.
Figure 4:
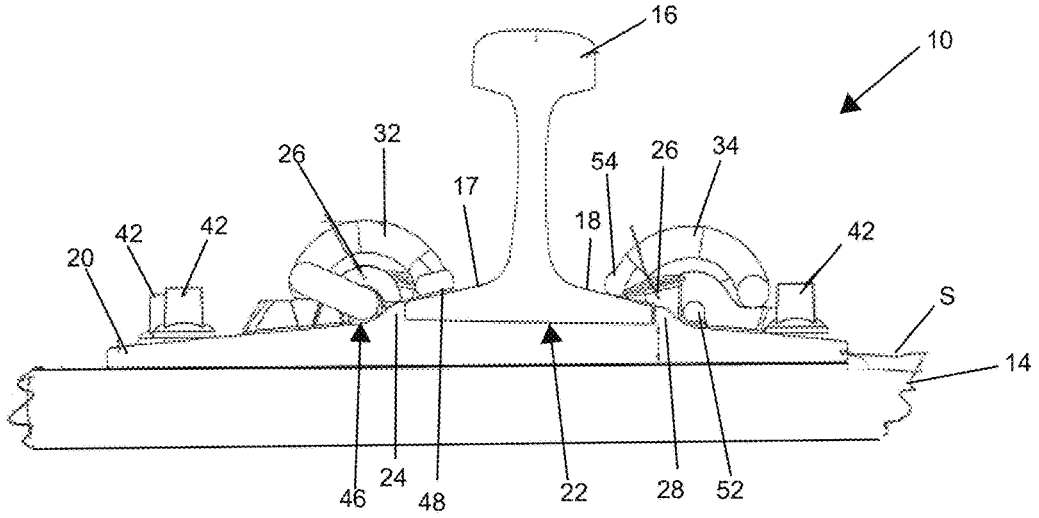
FIG. 4 is an end view of the plate assembly of FIG. 1.

With reference now to the drawings, and in particular to FIGS. 1-17, embodiments of tie plate assemblies will be described. To avoid redundancy, repetitive description of similar features may not be included. It shall be understood, however, that the description of a first-appearing feature applies to later described similar feature and each respective description, therefore, is to be incorporated therein within such repetition.

FIGS. 1-6 show details of a known tie plate assembly 10 that is mounted on a wooden tie 14 and on which tie plate assembly 10 a rail 16 that has a first flange 17 and a second flange 18 is mounted and supported. The tie plate assembly 10 includes a tie plate 20 that has a channel 22 that extends longitudinally about the plate 20 and in which the rail 16 can be arranged, a first ridge 24, a first shoulder 26 that is fixed to the tie plate 20 on a first side of the channel 22 and contactable the first shoulder 26, a second ridge 28, a second shoulder 30 that is spaced from the first shoulder 26 and fixed to the tie plate 18 on a second side of the channel 22 and contactable the second shoulder 30, a first clip 32, a second clip 34, and a plurality of first holes 36 and a plurality of second holes 38 that extend through the tie plate 20, straight spikes 40 and threaded spikes 42.

The first ridge 24 extends longitudinally about the plate 20 and delimits the channel 22 at a first side thereof. The second ridge 28 is spaced from the first ridge 24, extends longitudinally about the plate 20 and delimits the channel 22 at a second side thereof. The first clip 32 includes a first end portion 44 that is configured to be arranged partially within an opening 46 of the first shoulder 26 and a second end portion 48 that is configured to apply a retaining force on the first flange 17 of the rail 16. The second clip 34 includes a first end portion 50 that is configured to be arranged partially within an opening 52 of the second shoulder 30 and a second end portion 54 that is configured to apply a retaining force on the second flange 18 of the rail 16. The first holes 36 are configured to receive straight spikes 40 and the second holes 38 are configured to receive the threaded spikes 42. The spikes 40, 42, when inserted through the respective openings holes 36, 38 on the tie plate 20 and into the tie 14, secure the tie plate 20 to the tie 14.

Figure 5:
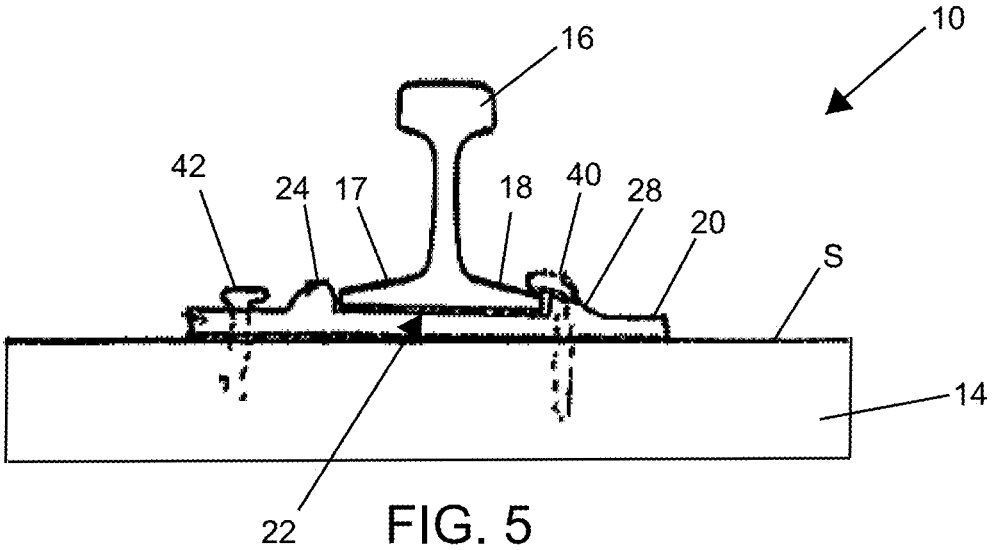
FIG. 5 is a partial cross-sectional view of the plate assembly of FIG. 1 with spikes extending through the known railway rail resting on a conventional tie plate assembly and into a tie.
Figure 6:
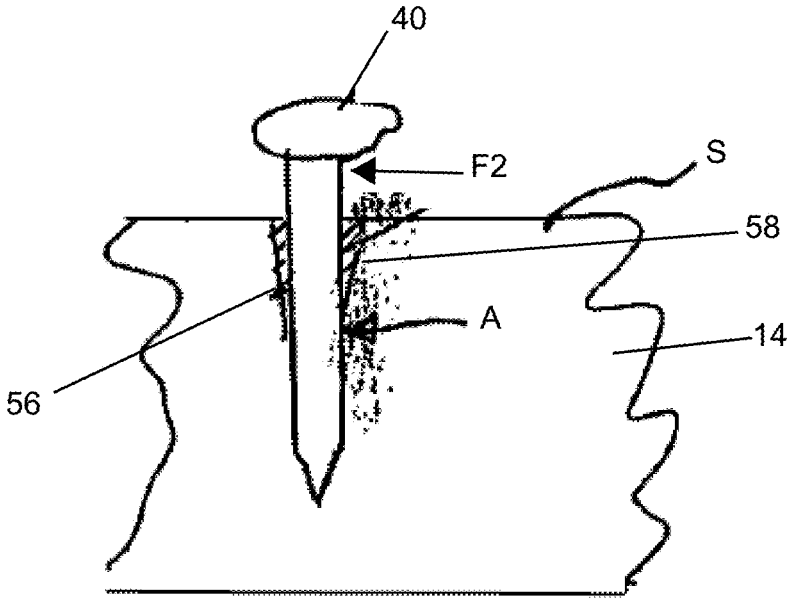
FIG. 6 is an enlarged cross-sectional view of a spike of the tie plate assembly of FIG. 1 disposed in a tie and a deformation zone shown on the sides of the tie due to lateral forces applied to the spike.

FIGS. 5 and 6 are simplified drawings of the tie plate assembly 10 with a straight spike 40 and a threaded spike 42 arranged in the wooden tie 14 to explain the formation of deformation zones and cavities in the wooden tie 14 as numerous heavy trains pass over the tie plate 20 and the tie 14. For the sake of clarity, some elements of the plate assembly 10 have been omitted in these drawings. As discussed above, lateral forces on the plate 20 that are generated by trains passing over the rail 16 are transmitted to the spikes 40, 42. Each time a train car passes over a plate assembly 10, the spikes 40, 42 bend or flex, causing deformation to the tie 14. For example, referring to FIG. 5, passing train cars can generate a first force F1 on the rail 16. The first force F1 is transmitted to the spikes 40, 42 as a second force F2, which is shown in FIG. 6. Over time, the second force F2 causes the spikes 40, 42 to bend in one or more directions. Here, in FIG. 6, due to the second force F2 applied to the plate 20, a straight spike 40 is bent to the left. After the second force F2 ceases (e.g., after each car wheel passes over the respective tie), the spike 40 returns substantially to its original linearly extending configuration, leaving a wood deformation zone or cavity 56 in the tie 14. A similar cavity 58 may form on the other side of the spike 40 as well. Over time, these cavities 56, 58 can grow larger, allowing the spike 40 to bend more and more until the spike 40 breaks due to fatigue, for example at point A as shown in FIG. 6. The point A of breakage generally occurs one to two inches below a surface S of the tie 14. Although FIG. 6 depicts a straight spike 40, it is noted that the same deformation(s) in the tie 14 can occur with a threaded spikes 42 as well.

FIGS. 7-17 depict embodiments of the present disclosure that include one or more sleeves that is/are attached to a tie plate in order to prevent spikes 40, 42 from bending and in turn cause deformation to a tie 14. It should be noted that although the embodiments described herein and depicted in the figures show holes of tie plate that are square or circular and sleeve(s) having a substantially square or circular shape fixed within the holes that the holes and associated sleeves can be of any shape that is known or may become known and the shape of the holes and associated sleeve(s) of a tie plate need not all be of the same shape.

Figure 7:
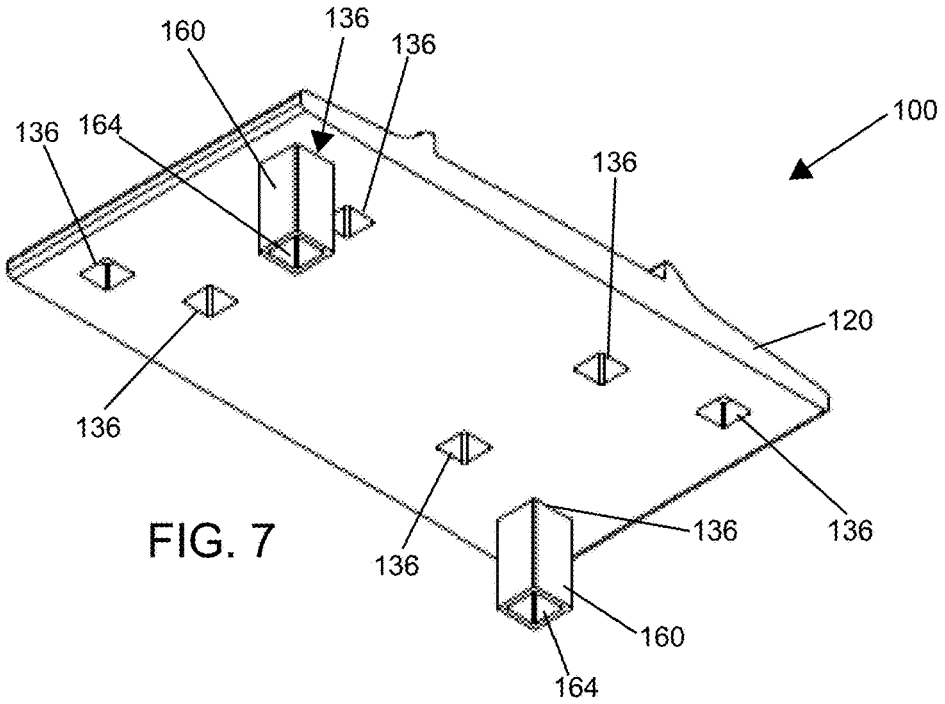
FIG. 7 is a first perspective view of an embodiment of a plate assembly of the present invention.

FIG. 7 depicts a tie plate assembly 100 that includes a tie plate 120 that has a plurality of holes 136 that extend therethrough and sleeves 160 that extend from holes 136 of the tie plate 120. Here, the holes 136 and the sleeves 160 are both substantially square. The sleeves 160, which are hollow, can be about of about 2-4 inches in length, and have an internal orifice 164 with an internal dimension d. In an embodiment, the internal dimension d of the sleeve 160 may be such that the external diameter of the spike 40, 42 fits securely or snuggly within the sleeve 160, 162, prohibiting substantial movement of the spike 40, 42 within the sleeve 160. It should be noted however, that the cross-sectional shape of orifice 164 need not match the shape of the respective spike 40, 42. As a result, when a force F2 is applied to the spike 40, 42, the sleeve 160 prevents the spike 40, 42 from bending. This is because the sleeve 160 applies uniform pressure to the tie 114 along zones surrounding the sleeve 160, preventing large deformations in an area of the tie 14 surrounding a spike 40, 42.

Figure 8:
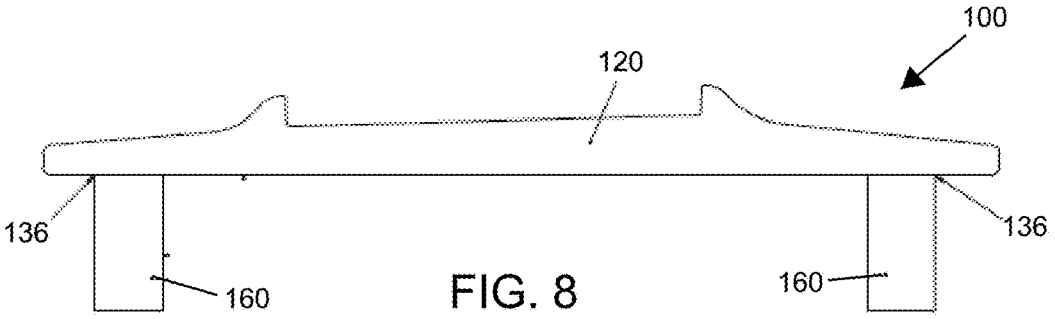
FIG. 8 is a side view of the plate assembly of FIG. 7.
Figure 9:
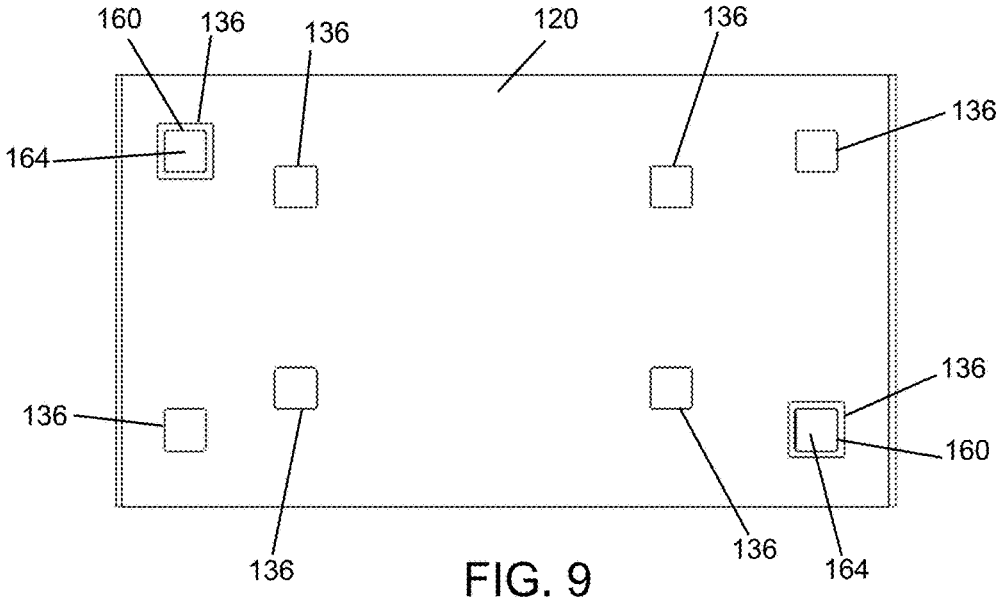
FIG. 9 is a bottom view of the plate assembly of FIG. 7.

FIG. 8 is a side view of the tie plate assembly 100 showing the sleeves 160 extending from the tie plate 120 and FIG. 9 is a bottom view of the tie plate assembly 100 showing the sleeves 160 arranged in holes 136 of the tie plate 120.

Figure 10:
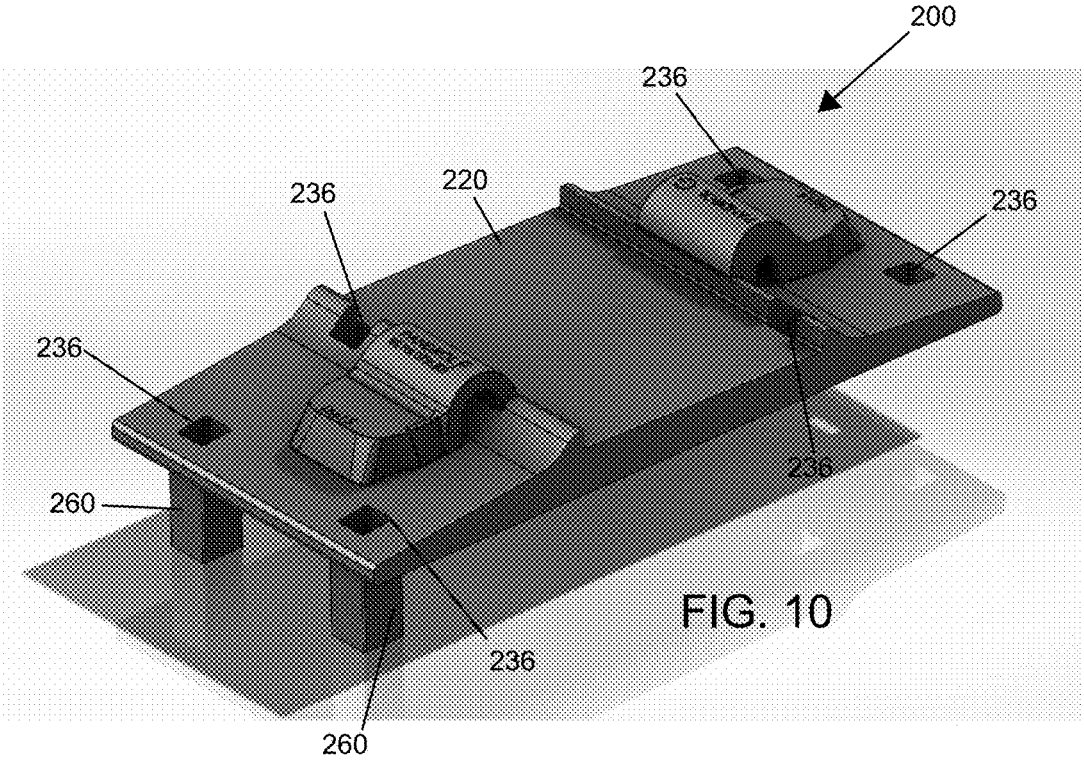
FIG. 10 is a first perspective view of a second embodiment of the plate assembly of the present invention.
Figure 11:
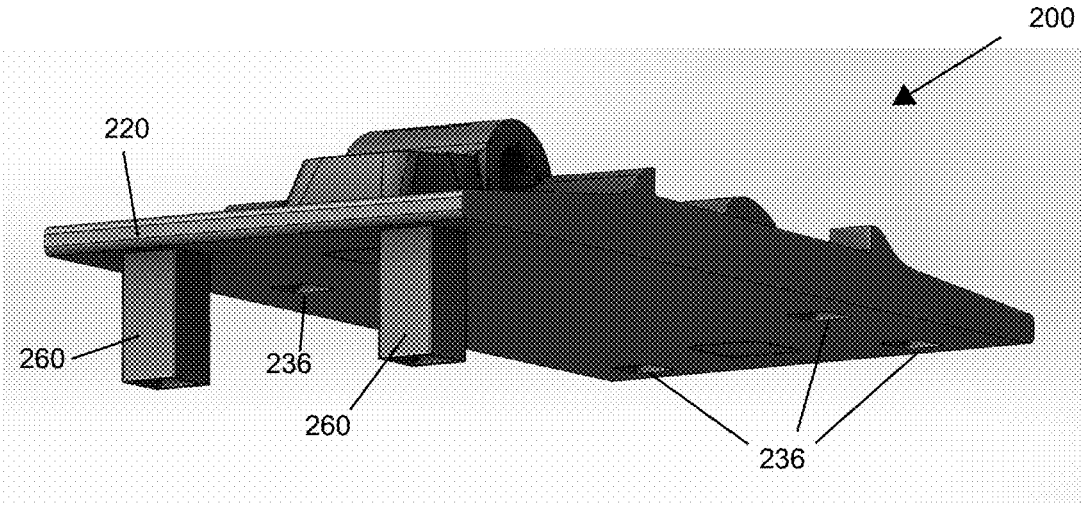
FIG. 11 is a second perspective view of the plate assembly of FIG. 10.

FIGS. 10 and 11 shows a second embodiment of a tie plate assembly 200 that includes a tie plate 220 with a plurality of holes 236 that extend therethrough and sleeves 260 that extends through two of the holes 236. As shown, the holes 236 and sleeves 260 are both substantially square with the sleeves 260 fixed within holes 236 and extend from a first side of the plate 220.

Figure 12:
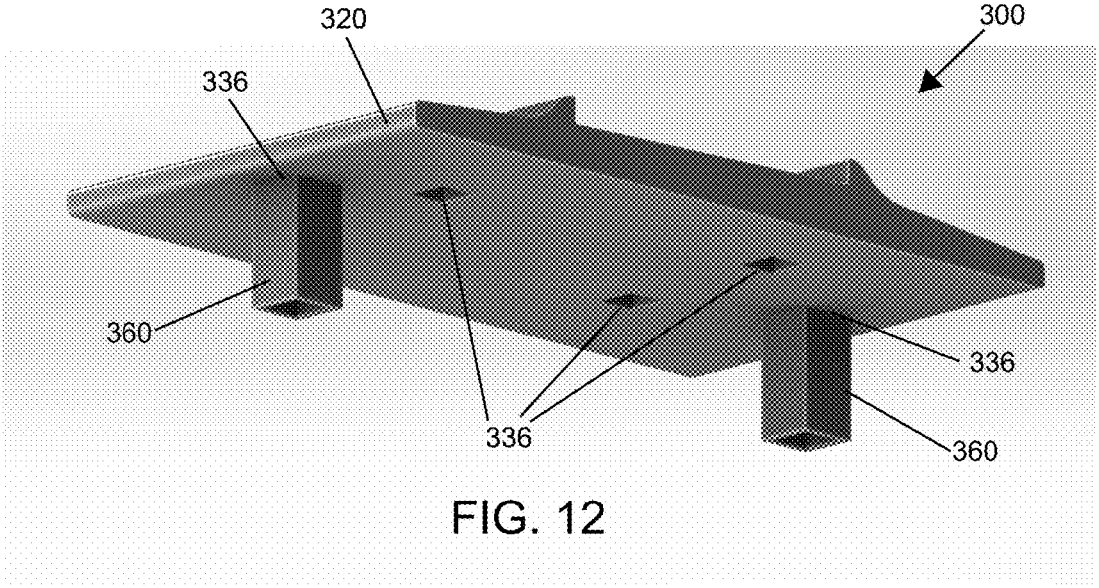
FIG. 12 is a perspective view of a third embodiment of a plate assembly of the present invention.

FIG. 12 shows a third embodiment of a tie plate assembly 300 that includes a tie plate 320 that has a plurality of holes 336 that extend therethrough sleeves 360 that extend from two of the holes 336. As shown, the holes 336 and sleeves 360 are both substantially square with one of the sleeves 360 fixed within one of the holes 336 formed in a first side of the plate 320 and another one of the sleeves 362 fixed within one of the holes 336 formed in a second side of the plate 320.

Figure 13:
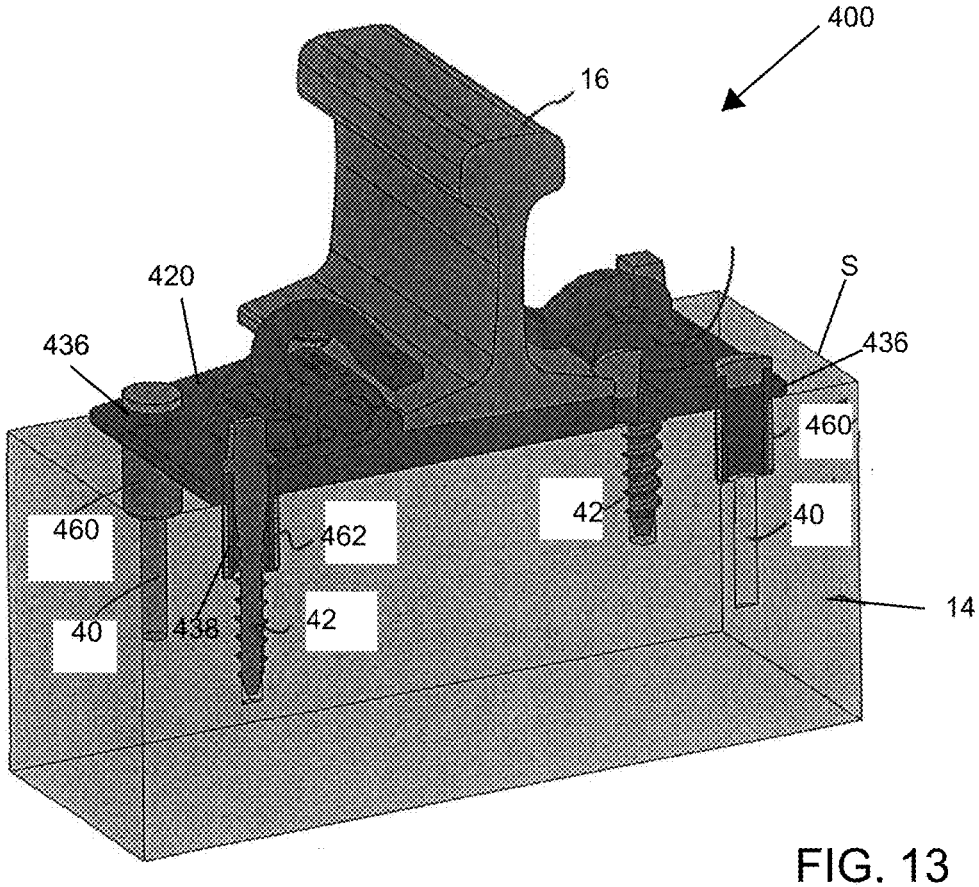
FIG. 13 is a perspective view of a fourth embodiment of the plate assembly of the present invention.

FIG. 13 depicts a fourth embodiment of a tie plate assembly 400 fixed to a tie 14 with a rail 16 secured on the tie plate 420. Here, the tie plate 420 includes a plurality of first holes 436, second holes 438 and third holes 439 with first sleeves 460 extending through the first holes 436, second sleeves 462 extending through the second holes 438 and third sleeves 463 extending through the third holes 437. The straight spikes 40 are arranged snuggly within the first sleeves 460 and threaded spikes 42 are arranged in the second sleeves 462. As can be seen, the sleeves 460, 426 and spikes 40, 42 extend through the plate 420 and into the tie 14 to secure the plate 420 to the tie 14.

Figure 14:
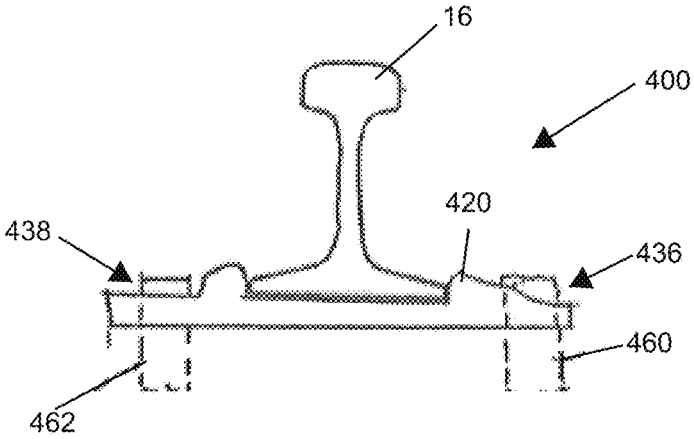
FIG. 14 is a partial cross-sectional end view of the plate assembly of FIG. 13.

FIG. 14 is a partial cross-sectional view of the tie plate 420 of FIG. 13 showing the sleeves 460, 462 arranged in the first holes 436 and second holes 438, respectively.

Figure 15:
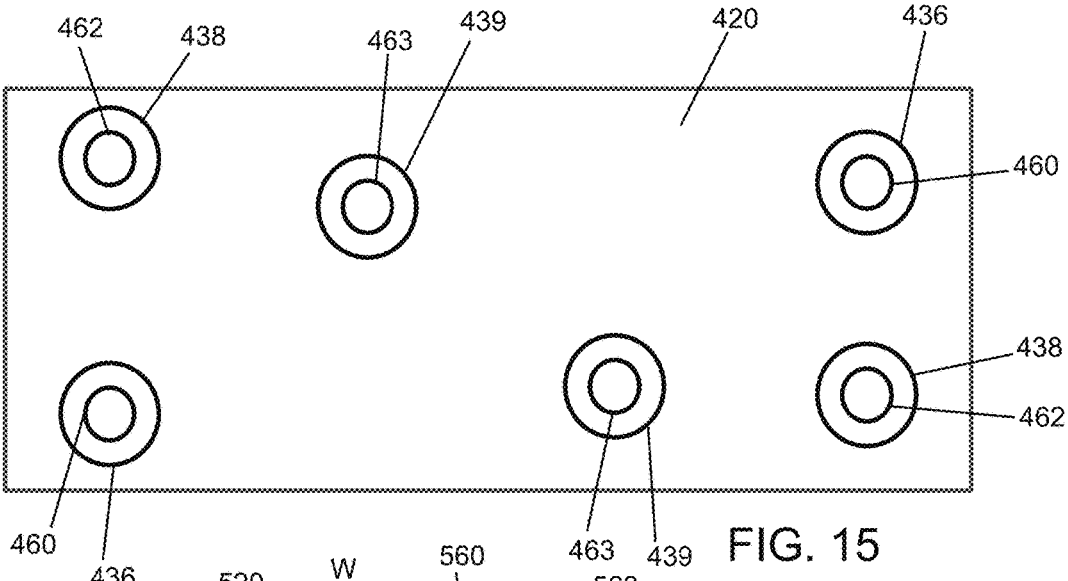
FIG. 15 is a bottom view of FIG. 13.

FIG. 15 is a bottom view of FIG. 13 showing the holes 436, 438, 439 and the sleeves 460, 462, 463 arranged in the respective holes 436, 438, 439 of the plate 420 for receiving the respective spikes 40, 42.

The sleeves 160, 260, 360, 460, 462, 463 may be made of a variety of materials or combinations thereof. In an embodiment, the sleeves 160, 260, 360, 460, 462, 463 may be made from the same material as the tie plate, such as steel. In another embodiment, the sleeves 160, 260, 360, 460, 462, 463 can be made of a plastic material. In yet another embodiment, the sleeves 160, 162, 260, 262, 360, 362, 460, 462 can be coated with a protective plastic or an external member (e.g., metal, plastic, elastomeric, etc.) can be arranged over the exterior periphery of the sleeve 160, 260, 360, 460, 462, 463.

In an embodiment, the plate 120, 220, 320, 420 and sleeves 160, 260, 360, 460, 462, 463 associated therewith can be made in a single step by molding, casting, stamping or other similar process.

Figure 16:
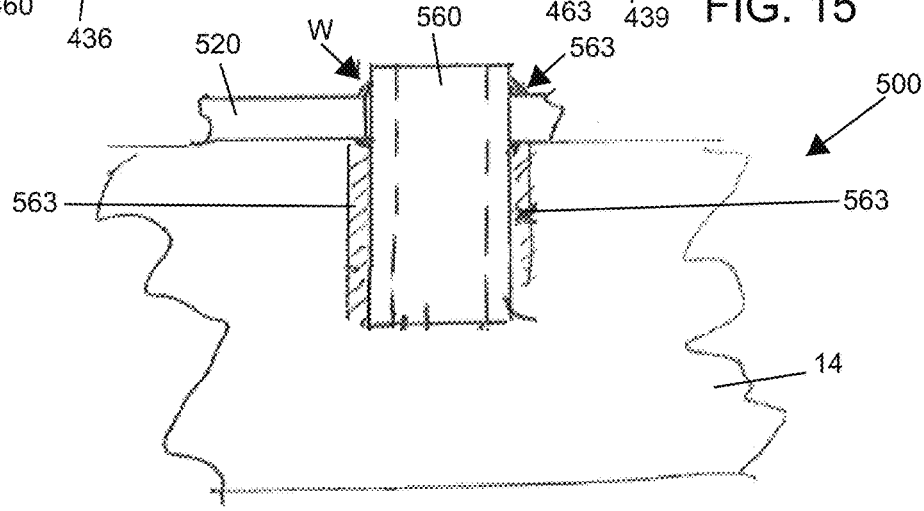
FIG. 16 is an embodiment of a sleeve arranged within an opening of a plate and welded thereto.

As shown in an embodiment in FIG. 16, a tie plate assembly 500 can include a tie plate 520 that has a hole 536 in which a sleeve 560 (i.e., rigid cylinder) can be arranged and welded W to the plate 520 or attached by other well-known means (e.g., adhesive, press-fit, etc.). When inserted in the holes 536, the sleeve 560 applies uniform pressure along the deformation zones 563 surrounding the sleeve 560, preventing large deformations in an area of the tie surrounding a spike.

Figure 17:
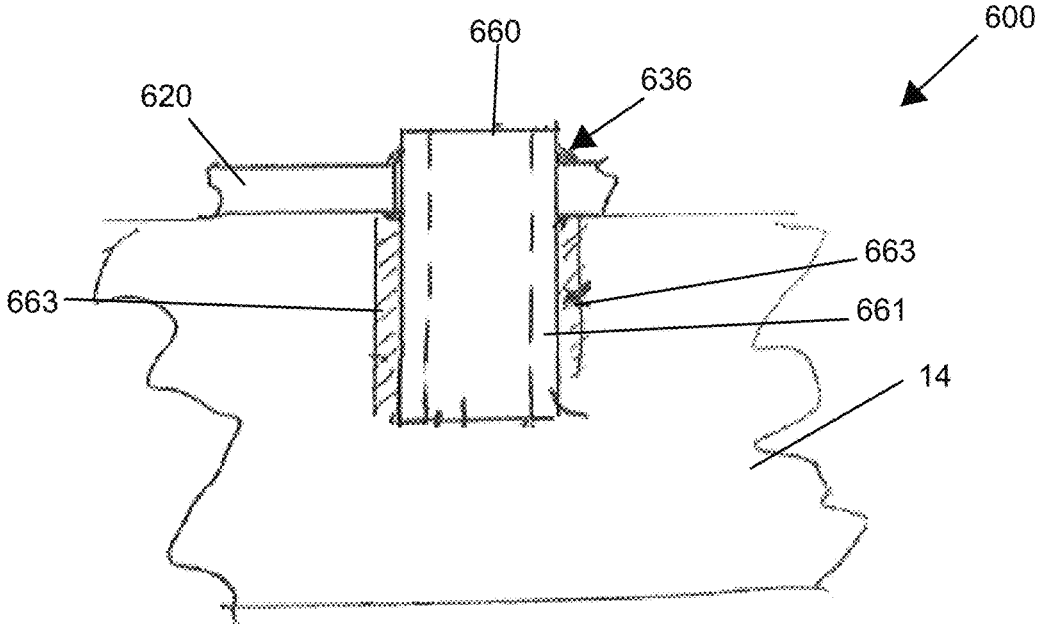
FIG. 17 is an embodiment of a sleeve arranged within an opening of a plate and fixed therein.

As shown in an embodiment in FIG. 17, a tie plate assembly 600 can include a tie plate 620 that has a hole 636 in which a sleeve 660 (i.e., rigid cylinder) that has been coated with a protective material and/or includes an external member 661 (e.g., plastic bushing) arranged over the outer periphery of the sleeve 600 before installing the sleeve 660 into the hole 636 of the plate 620. When inserted in the holes 636, the sleeve 660 applies uniform pressure along the deformation zones 663 surrounding the sleeve 660, preventing large deformations in an area of the tie surrounding a spike.

In another embodiment, the holes 136, 236, 336, 436, 438, 439, 536, 636 in the respective plates 120, 220, 320, 420, 520, 620 can have the same cross-sectional diameter and shape as the internal diameter of the respective sleeve 160, 260, 360, 460, 462, 463, 560, 660 and the sleeves 160, 260, 360, 460, 462, 463, 560, 660 can be attached to a bottom surface of the respective plate 120, 220, 320, 420, 520, 620.

Figure 18:
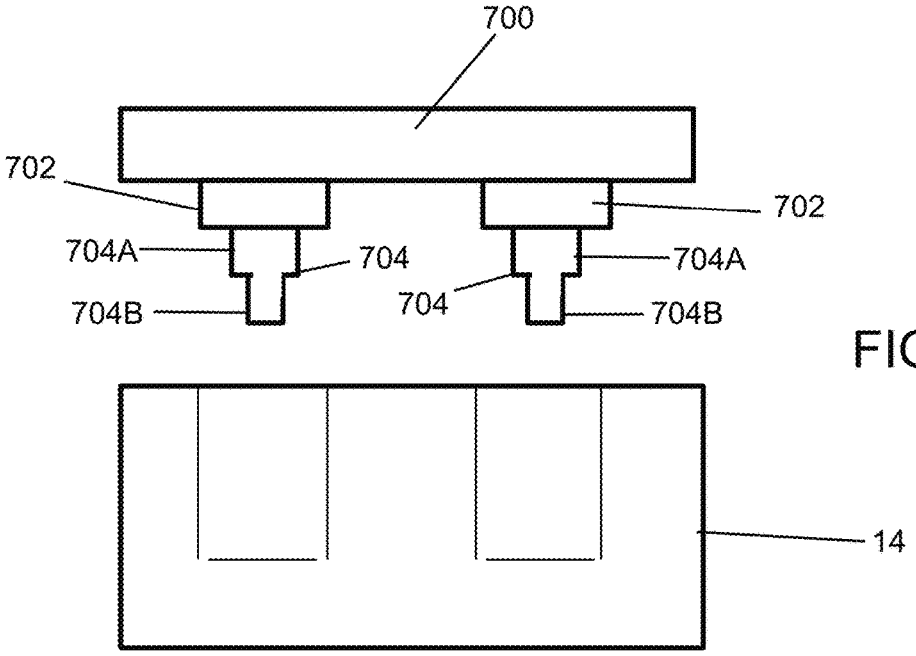
FIG. 18 is a manufacturing view of holes being formed in a tie.

Regardless of plate assembly 100-600 elected for use in conjunction with a tie, the tie must be properly prepared. More particularly, holes must be formed in the tie to accommodate the sleeves and spikes. These holes can be individually drilled using conventional means. Alternatively, a more efficient technique involves the use of multiple drills simultaneously. For example, in an embodiment, a jig 700 (see FIG. 18) includes a plurality of drill heads 702 disposed in a pattern similar to the pattern of sleeves shown in FIG. 13. Each drill head 702 can include a multistage drill bit 704 that has a first stage 704A with a large diameter corresponding to the outer diameter of sleeves (e.g., 460, 462) and a second stage 704B that is smaller than the cross-sectional dimension of respective spikes 40, 42. The jig 700 is then lowered by a predetermined distance toward the tie 14 while the drill heads 702 are activated to form desired holes in which the sleeves and spikes can then be arranged. Once the holes are formed at a desired depth, the jig 700 is raised.

The accompanying drawings illustrate embodiments of present invention and its respective constituent parts, however, other types and styles are possible, and the drawings are not intended to be limiting in that regard. Thus, although the description above and accompanying drawings contains much specificity, the details provided should not be construed as limiting the scope of the embodiment, but merely as providing illustrations of some of the features of the embodiment. The drawings and the description are not to be taken as restrictive on the scope of the embodiment and are understood as broad and general teachings in accordance with the present invention. While the present embodiment has been described using specific terms, such description is for illustrative purposes only, and it is to be understood that modifications and variations to such embodiment, including, but not limited to, the substitutions of equivalent features, materials, or parts, and the reversal of various features thereof, may be practiced by those of ordinary skill in the art without departing from the spirit and scope of the invention.

What is claimed is:

1. A tie plate assembly comprising:

a tie plate having a first surface, a second surface, a plurality of holes that are spaced from each other and extend through the tie plate between the first surface and the second surface and a plurality of sleeves that are each delimited by a first end and a second end and fixed at the first end thereof to and extend from the second surface of the tie plate at an outer periphery of each of the holes, the sleeves each being configured to receive a spike and extend into an opening in a railroad tie when the tie plate is mounted on the railroad tie and the sleeves being dimensioned to prevent lateral flexing of the spike after the spike has been inserted through one of the holes and one of the sleeves associated with the one of the holes.

2. The tie plate assembly of claim 1, wherein each of the sleeves and each of the holes are concentric to each other.

3. The tie plate assembly of claim 1, wherein each of the sleeves is made of a plastic material.

4. The tie plate assembly of claim 1, wherein each of the sleeves and the tie plate are made of steel.

5. The tie plate assembly of claim 4, wherein the each of the sleeves are welded to the tie plate.

6. The tie plate assembly of claim 4, wherein the each of the sleeves are coated with a protective layer.

7. A tie plate, comprising:

a tie plate body that is configured to support a rail thereon having a top surface, a generally linearly extending bottom surface, a hole extending through the tie plate body between the top surface and the bottom surface, a hollow sleeve delimited by a first end and a second end and fixed at the first end thereof to the bottom surface of the tie plate body at an outer periphery of the hole and the second end spaced away from the tie plate, the hole and the sleeve together defining an orifice that is configured to receive a spike with the sleeve configured to be arranged in an opening in a wood tie, the spike configured to extend through the sleeve and secure the tie plate body on a tie, the sleeve being sized and shaped to prevent deflection of the spike when the spike is inserted through an orifice extending through the sleeve and is imbedded in the wood tie.

8. The tie plate of claim 7, wherein the sleeve is welded to the tie plate body.

9. The tie plate of claim 7, wherein the sleeve and the hole in the tie plate body have matching cross-sectional shapes.

10. The tie plate of claim 9, wherein the sleeve is circular.

11. A method of attaching a tie plate to a tie, the method comprising the steps of:

providing a tie plate having a first surface, a generally linear second surface, at least one hole extending through the tie plate between the first surface and the second surface and at least one sleeve that has an orifice that extends therethrough, is delimited at a first end and a second end and fixed at the first end thereof and extends from the second surface of the tie plate at an outer periphery of the hole, attaching the tie plate to the tie with the sleeve extending into the tie; and driving a spike through the hole in the tie plate and the orifice in the sleeve until a portion of the spike is imbedded in the tie and the tie plate is secured to the tie such that the sleeve is positioned to prevent lateral deflection of the spike.

12. The method of claim 11, wherein the sleeve extends into the tie by about 1 to 2 inches.

13. The method of claim 11, further comprising the step of predrilling the tie to form a hole therein that is sized to receive the sleeve.

14. The method of claim 11, wherein the bottom surface of the tie plate has a plurality of sleeves that are fixed thereto and arranged in a pattern and the method further comprises the step of predrilling a plurality of holes in the tie simultaneously that are sized to receive the sleeves.

15. The method of claim 11, wherein the bottom surface of the tie plate has a plurality of sleeves that are fixed thereto and arranged in a pattern, and he method further comprises the steps of providing a jig having a plurality of drill heads that are arranged in a pattern and predrilling a plurality of holes in the tie using the jig and the drill heads associated therewith.

16. The tie plate assembly of claim 1, wherein the sleeve extends continuously about a circumference.

* * * * *